US005097900A

United States Patent [19]

Yamaguchi

[11] Patent Number: 5,097,900

[45] Date of Patent: Mar. 24, 1992

[54] CONDENSER HAVING PARTITIONS FOR CHANGING THE REFRIGERANT FLOW DIRECTION

[75] Inventor: Toru Yamaguchi, Isesaki, Japan

[73] Assignee: Sanden Corporation, Gunma, Japan

[21] Appl. No.: 473,830

[22] Filed: Feb. 2, 1990

[30] Foreign Application Priority Data

Feb. 2, 1989 [JP] Japan ..... 1-10751[U]

[51] Int. Cl.[5] ..... F28F 9/26

[52] U.S. Cl. ..... 165/174; 165/173; 165/176; 29/890.052

[58] Field of Search ..... 165/176, 173, 174

[56] References Cited

U.S. PATENT DOCUMENTS 3,596,495 8/1971 Huggins .
3,835,920 9/1974 Mondt ..... 165/176
4,410,036 10/1983 Kanada et al. .
4,825,941 5/1989 Hoshino et al. .
4,829,780 5/1989 Hughes ..... 165/176

FOREIGN PATENT DOCUMENTS 1265756 5/1961 France .
63-112065 5/1988 Japan .
2078361 1/1982 United Kingdom ..... 165/176

*Primary Examiner*—Albert W. Davis, Jr.
*Attorney, Agent, or Firm*—Banner, Birch, McKie & Beckett

[57] ABSTRACT

An automotive air conditioning system condenser is disclosed. The condenser includes a plurality of tubes having opposite first and second open ends, and a plurality of fin units disposed between the plurality of tubes. First and second header pipes are fixedly disposed at the opposite ends respectively, and the open ends of the tubes are disposed in fluid communication with the interior of the header pipes. The first header pipe has an inlet which links the condenser to an external element of the circuit. The first header pipe also has an outlet which links the condenser to an external element of the circuit. Partitions are provided in the header pipes to create isolated chambers therein. The partition comprises a horizontal portion with a peripheral portion extending perpendicularly to the horizontal portion. The partition is inserted into the header pipe through an open end.

17 Claims, 7 Drawing Sheets

CONDENSER HAVING PARTITIONS FOR CHANGING THE REFRIGERANT FLOW DIRECTION

BACKGROUND OF THE INVENTION

1. Technical Field

The present invention relates to a heat exchanger, and more particularly, to a heat exchanging condenser for use in an automative air-conditioning system.

2. Description of the Prior Art

With reference to FIG. 1, a conventional refrigerant circuit for use, for example, in an automotive air-conditioning system is shown. Circuit 1 includes compressor 10, condenser 20, receiver or accumulator 30, expansion device 40, and evaporator 50 serially connected through pipe members 60 which link the outlet of one component with the inlet of a successive component. The outlet of evaporator 50 is linked to the inlet of compressor 10 through pipe member 60 so as to complete the circuit. The links of pipe members 60 to each component of circuit 1 are made such that the circuit is hermetically sealed.

In operation of circuit 1, refrigerant gas is drawn from the outlet of evaporator 50 and flows through the inlet of compressor 10, and is compressed and discharged to condenser 20. The compressed refrigerant gas in condenser 20 radiates heat to an external fluid flowing through condenser 20, for example, atmospheric air, and condenses to the liquid state. The liquid refrigerant flows to receiver 30 and is accumulated therein. The refrigerant in receiver 30 flows to expansion device 40, for example, a thermostatic expansion valve, where the pressure of the liquid refrigerant is reduced. The reduced pressure liquid refrigerant flows through evaporator 50, and is vaporized by absorbing heat from a fluid flowing through the evaporator, for example, atmospheric air. The gaseous refrigerant then flows from evaporator 50 back to the inlet of compressor 10 for further compression and recirculation through circuit 1.

With further reference to FIGS. 1*a*, and 2–5, a prior art embodiment of condenser 20 as disclosed in Japanese Patent Application Publication No. 63-112065 is shown. Condenser 20 includes a plurality of adjacent, essentially flat tubes 21 having an oval cross-section and open ends which allow refrigerant fluid to flow therethrough. A plurality of corrugated fin units 22 are disposed between adjacent tubes 21. Circular header pipes 23 and 24 are disposed perpendicularly to flat tubes 21 and may have, for example, a clad construction. Each header pipe 23 and 24 includes outer tube 26 which may be made from aluminum and inner tube 28 made of a metal material which is brazed to the inner surface of outer tube 26. Outer tube 26 has slits 27 disposed therethrough. Flat tubes 21 are fixedly connected to header pipes 23 and 24 and are disposed in slits 27 such that the open ends of flat tubes 21 communicate with the hollow interior of header pipes 23 and 24. Inner tube 28 includes portions 28*a* which define openings corresponding to slits 27. Portions 28*a* are brazed to the inner ends of flat tubes 21 and ensure that tubes 21 are hermetically sealed within header pipes 23 and 24 when inserted in slits 27.

Header pipe 23 has an open top end and a closed bottom end. The open top end is sealed by inlet union joint 23*a* which is fixedly and hermetically connected thereto. Inlet union joint 23*a* is linked to the outlet of compressor 10. Partition wall 23*b* is fixedly disposed within first header pipe 23 at a location about midway along its length and divides header pipe 23 into upper cavity 231 and lower cavity 232 which is isolated from upper cavity 231. Second header pipe 24 has a closed top end and an open bottom end. The open bottom end is sealed by outlet union joint 24*a* fixedly and hermetically connected thereto. Outlet union joint 24*a* is linked to the inlet of receiver 30. Partition wall 24*b* is fixedly disposed within second header pipe 24 at a location approximately one-third of the way along the length of second header pipe 24 and divides second header pipe 24 into upper cavity 241 and lower cavity 242 which is isolated from upper cavity 241. The location of partition wall 24*b* is lower than the location of partition wall 23*a*.

In operation, compressed refrigerant gas from compressor 10 flows into upper cavity 231 of first header pipe 23 through inlet union joint 23*a*, and is distributed such that a portion of the gas flows through each of flat tubes 21 which are disposed above the location of partition wall 23*b*, and into an upper portion of upper cavity 241. Thereafter, the refrigerant in the upper portion of cavity 241 flows downward into a lower portion of upper cavity 241, and is distributed such that a portion flows through each of the plurality of flat tubes 21 disposed below the location of partition wall 23*b* and above the location of partition wall 24*b*, and into an upper portion of lower cavity 232 of first header pipe 23. The refrigerant in an upper portion of lower cavity 232 flows downwardly into a lower portion, and is again distributed such that a portion flows through each of the plurality of flat tubes 21 disposed below the location of partition wall 24*b*, and into lower cavity 242 of second header pipe 24. As the refrigerant gas sequentially flows through flat tubes 21, heat from the refrigerant gas is exchanged with the atmospheric air flowing through corrugated fin units 22 in the direction of arrow W as shown in FIG. 5. Since the refrigerant gas radiates heat to the outside air, it condenses to the liquid state as it travels through tubes 21. The condensed liquid refrigerant in cavity 242 flows out therefrom through outlet union joint 24*a* and into receiver 30 and the further elements of the circuit as discussed above.

With reference to FIG. 6 a portion of a similar prior art condenser which is disclosed in U.S. Pat. No. 4,825,941 is shown. Header pipe 13 includes slit 29 formed on an opposite side thereof from slits 27 and at a vertical location between two adjacent slits 27. Although not shown in the Figure, header pipe 13 could include a brazing layer 28 as shown in FIG. 4. Partition plate 70 includes smaller diameter semi-circular portion 70*a* and larger diameter semi-circular portion 70*b* integrally formed such that the two semi-circular portions are joined at their chordal surfaces. Portion 70*a* has a radius substantially equal to the inner radius of header pipe 13 and portion 70*b* has a radius substantially equal to the outer radius of header pipe 13. Partition plate 70 is disposed and soldered in slit 29 such that portion 70*a* fits flush against the inner surface of pipe 13 and the outer surface of portion 70*b* is disposed so as to be substantially even with the outer surface of header pipe 13. Both plate 70 and header pipe 13 are provided with layers of solder so as to ensure that no leakage of refrigerant fluid occurs between the interior portions of pipe 13 which are separated by plate 70, or from the interior of pipe 13 to the outside.

In the condenser shown in FIG. 6, header pipe 13 must be formed with a plurality of slits 29 and a corresponding plurality of partitions 70 having circular portions 70*a* and 70*b*, as described above. The process for constructing headers of this type is complicated and results in a great deal of wasted time and material if the parts do not fit or seal properly. Additionally, condensers are disposed at the high pressure side of a refrigeration circuit, and also may be mounted within the engine compartment in a position where they will be subjected to numerous highly concussive vibrations. As a consequence of the vibrations and the high pressure of the refrigerant in the condenser, undesirable leakage of the refrigerant through slits 29 to the atmosphere may occur. Therefore, lit is not desirable to increase the number of slits in header pipe 13 by the addition of slits 29 since this increase results in a corresponding increase in the possibility of refrigerant leaking to the outside of pipe 13.

SUMMARY OF THE INVENTION

The present invention is directed to a condenser for a refrigerant fluid circuit. The condenser includes a plurality of tubes having opposite first and second open ends, and a plurality of fin units disposed between the plurality of tubes. First and second header pipes are fixedly disposed at the opposite ends respectively, and the open ends of the tubes are disposed in fluid communication with the interior of the header pipes. The first header pipe has an inlet which links the condenser to an external element of the circuit. The first header pipe also has an outlet which links the condenser to an external element of the circuit. Partitions are provided in at least one of the header pipes to create isolated chambers therein. The partition comprises a horizontal portion with a peripheral portion extending perpendicularly to the horizontal portion. The partition is inserted into the header pipe through an open end.

In a further embodiment, the outer diameter of the partition is substantially equal to the inner diameter of the header pipes.

In a further embodiment the peripheral portion comprises a hollow cylinder and the horizontal portion comprises a disc.

In a further embodiment the peripheral portion comprises a a hollow conical slice and the horizontal portion comprises a solid conical slice.

In a further embodiment the a peripheral portion extends from both sides of the horizontal portion.

The present invention provides the first advantage that the condenser is constructed to withstand concussive vibrations and the high pressure of the refrigerant flowing therethrough so as to reliably prevent leakage of the refrigerant to the outside. The invention provides the additional advantage that the construction of the condenser is simplified and the need for slits through which the partitions are disposed is eliminated.

Further objects, features and aspects of this invention will be understood from the following detailed description of the preferred embodiments of this invention with references to the drawings.

BRIEF DESCRIPTION OF THE DRAWINGS

FIG. 8(*b*) is a perspective view of a partition as shown in FIG. 8(*a*).

FIG. 9(*b*) is a perspective view of a partition as shown in FIG. 9(*a*).

FIG. 10(*b*) is a perspective view of a partition as shown in FIG. 10(*a*).

DETAILED DESCRIPTION OF THE PREFERRED EMBODIMENTS

Figure 7:
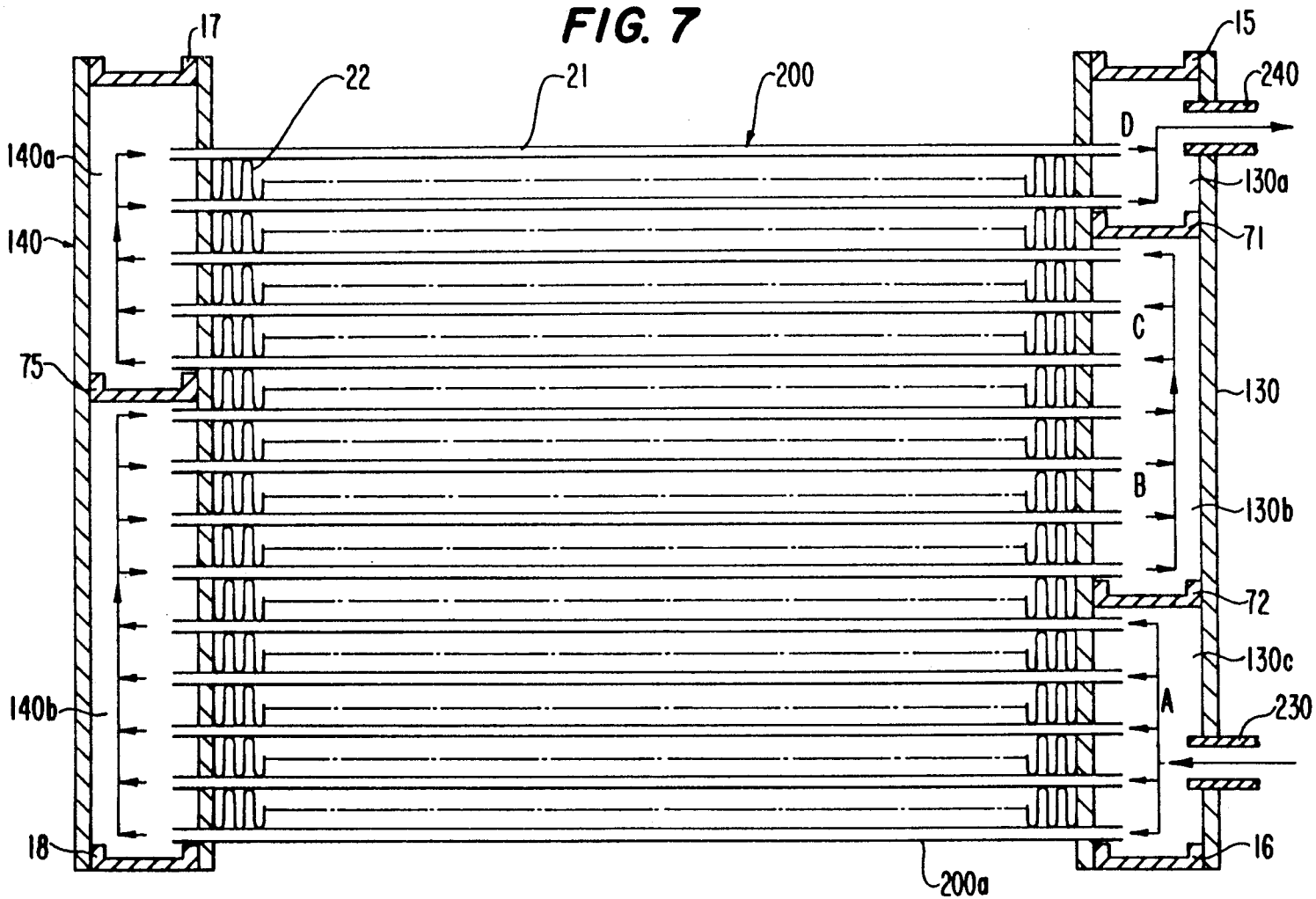
FIG. 7 is a cross-sectional view of a condenser in accordance with a first embodiment of the present invention.

With reference to FIG. 7, a condenser in accordance with a first embodiment of the present invention is shown. In the Figures, the same reference numerals are used to denote corresponding elements shown in the prior art figures. Therefore, a complete explanation of those elements is omitted. Condenser 200 includes a plurality of flat or planar tubes 21, and a plurality of corrugated fin units 22 alternately arranged and forming heat exchange region 200*a*. Flat tubes 21 are preferably made of aluminum and have a multi-hollow construction, that is, flat tubes 21 include a plurality of longitudinally disposed dividing walls such that each flat tube includes a plurality of parallel flow paths. This construction increases the surface area the refrigerant fluid contacts as it flows through the flat tubes. Flat tubes 21 are disposed in slots 27 in header pipes 130 and 140 disposed at the opposite ends of the flat tubes as discussed with respect to FIG. 4.

Open-ended header pipes 130 and 140 are cylindrical and are preferably made of aluminum. Although not shown in FIG. 7, header pipes 130 and 140 could include a brazing portion as discussed with respect to FIG. 4. Partitions 71 and 72 are disposed at an upper and a lower location within header pipe 130 and upper plug 15 is disposed in the top open end and lower plug 16 is disposed in the lower open end. The partitions and plugs divide header pipe 130 into upper fluid chamber 130*a*, intermediate fluid chamber 130*b* and lower fluid chamber 130*c*. The three chambers are isolated from each other. Pipe 240 is disposed through header pipe 130 and links upper chamber 130*a* with further elements of the refrigerant circuit. Pipe 230 is also disposed through header pipe 130 and links lower chamber 130*c* with further elements of the refrigerant circuit. Header pipe 140 includes partition 75 disposed therein at a location which is higher than partition 72 and lower than partition 71, and upper plug 17 and lower plug 18 disposed in the top and bottom open ends. Partition 75 and plugs 17 and 18 divide header pipe 140 into upper fluid chamber 140*a* and lower fluid chamber 140*b* which are isolated from each other.

With further reference to FIG. 7, tubes 21 are divided into four groups due to the provision of partitions 71, 72 and 75. Lower group A is disposed below the location of partition 72, lower middle group B is disposed above the location of partition 72 and below the location of partition 75, upper middle group C is disposed above the location of partition 75 and below the location of partition 71 and upper group D is disposed above the location of partition 71. Additionally, the number of tubes in each group may be decreased proceeding from the lower groups to the upper groups. That is, group A may have more tubes than group B, group B may have more tubes than group C, and group C may have more tubes than group D. For example, as shown, group A may have five tubes, group B may have four tubes, group C may have three tubes and group D may have two tubes. Thus the total effective cross sectional area for heat exchange of each group decreases accordingly from group A through group D.

In operation of the condenser, the compressed refrigerant gas enters through inlet pipe 230 and proceeds through the condenser in the direction of the arrows. The gaseous refrigerant in lower chamber 130*c* is distributed such that a portion flows through each of tubes 21 in group A and into a lower part of lower chamber 140*b*. The refrigerant in the lower part of lower chamber 140*b* flows to an upper part thereof and is distributed such that a portion flows through each of tubes 21 in group B, and into a lower part of intermediate chamber 130*b*. Of course, the flow direction in group B is opposite to the flow direction in group A. In a similar manner, the refrigerant is again distributed and flows through the tubes in group C into a lower part of upper chamber 140*a*, and through the tubes in group D and into upper chamber 130*a*. As the refrigerant flows through flat tubes 21, it exchanges heat with the air passing through fin units 22 and condenses to the liquid state.

When the refrigerant first enters the tubes in group A, it is entirely in the gaseous state. However, when the refrigerant enters the tubes in group B, a large portion has already condensed to the liquid state. Thus, as is shown in the Figures, it is advantageous to have the effective cross sectional area for heat exchange of group B be less than group A since the volume of a mass of the refrigerant in group B is less than the volume of an equivalent mass in group A since much of the refrigerant has already condensed. Thus less cross-sectional area is needed in group B for efficient heat exchange. Similarly, when the refrigerant enters the tubes in group C, even less of the refrigerant is in the gaseous state, and accordingly, the cross-sectional area of group C is less than the cross-sectional area of group B. By the time the refrigerant reaches group D, it is substantially in the liquid state and the liquid is effectively super-cooled in the tubes in group D. In this manner, the refrigerant smoothly flows through the condenser and efficient heat exchange occurs.

Figure 8A:
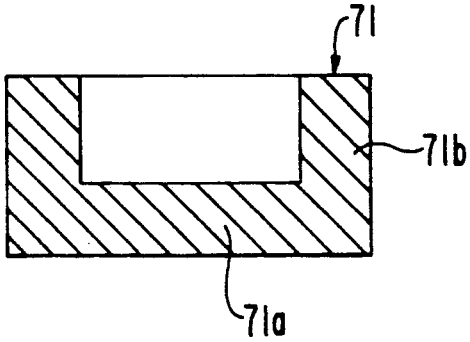
FIG. 8(*a*) is a cross-sectional view of a partition in accordance with a first embodiment of the present invention.
Figure 8B:
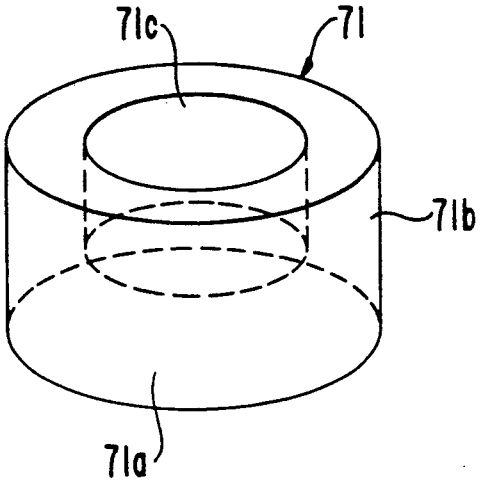

With reference to FIGS. 8(*a*) and 8(*b*), the construction of a partition in accordance with a first embodiment of the present invention is shown. Partition 71 has an overall cylindrical shape and includes circular hole 71*c* extending partially therethrough from one planar surface. Due to hole 71*c* partition 71 effectively comprises solid cylindrical or disc portion 71*a* integrally formed with hollow cylindrical portion 71*b*. As shown in FIG. 8*a*, a vertical cross section of partition 71 would appear U-shaped with peripheral portions 71*b* integrally formed with and extending from planar or horizontal portion 71*a*. The outer diameter of cylindrical partition 71 is selected to be equal to or slightly smaller than the inside diameter of header pipes 130 and 140. In condenser 200 as shown in FIG. 7, partitions 72 and 75, as well as plugs 15, 16, 17 and 18 are of the same construction as partition 71.

Figure 9A:
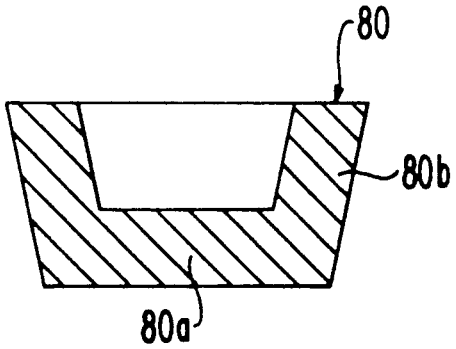
FIG. 9(*a*) is a cross-sectional view of a partition in accordance with a second embodiment of the present invention.
Figure 9B:
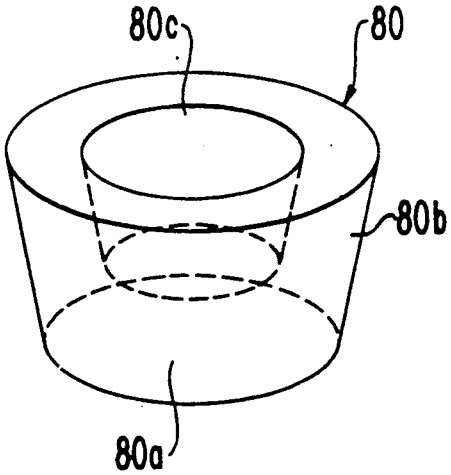

With reference to FIGS. 9(*a*) and 9(*b*), the construction of a partition in accordance with a second embodiment of the present invention is shown. Partition 80 has an overall frusto-conical shape and includes frusto-conical hole 80*c* extending partially therethrough from the base. Due to hole 80*c*, partition 80 effectively comprises solid conical slice portion 80*a* integrally formed with hollow conical slice portion 80*b* at the narrow cross-sectional end of portion 80*b* and the broader cross-sectional end of portion 80*a*. As shown in FIG. 9*b*, a vertical cross-section of partition 80 would appear as an outwardly sloping U-shape with peripheral portions 80*b* integrally formed with and extending from planar or horizontal portion 80*a*. The outer diameter of the base of frusto-conical partition 80 is selected to be equal to or slightly smaller than the inside diameter of header pipes 130 and 140.

Figure 10A:
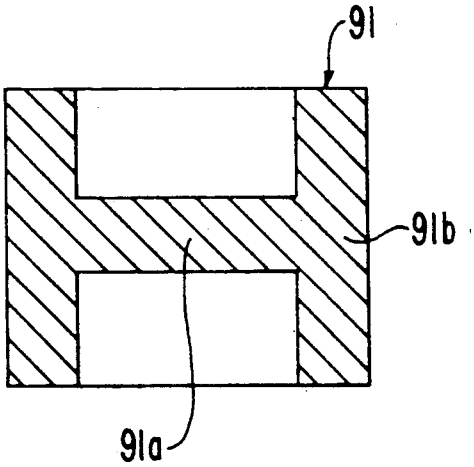
FIG. 10(*a*) is a cross-sectional view of a partition in accordance with a third embodiment of the present invention.
Figure 10B:
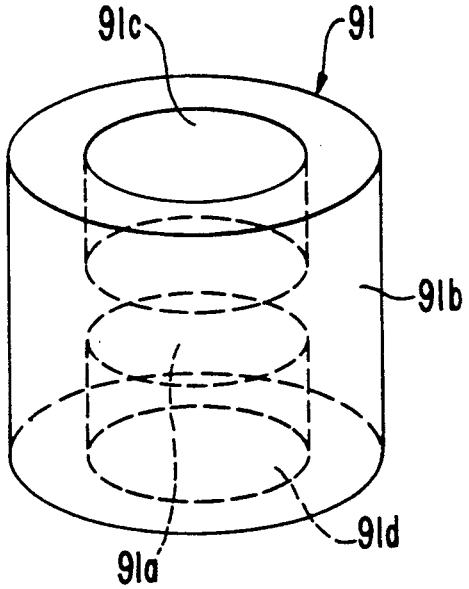

With reference to FIGS. 10(*a*) and 10(*b*), the construction of a partition in accordance with a third embodiment of this invention is shown. Partition 91 has an overall cylindrical shape and includes circular holes 91*c* and 91*d* extending partially therethrough from both planar surfaces. Due to holes 91*c* and 91*d*, partition 91 effectively comprises hollow cylindrical portion 91*b* integrally formed with circular disc portion 91*a* disposed therein. Circular disc portion 91*a* is disposed about the longitudinal axis at a position intermediate of the planar surfaces of partition 91. As shown in FIG. 10*a*, a vertical cross section of partition 91 would appear H-shaped with vertical portions 91*b* integrally formed with and extending from planar or horizontal portion 91*a*. The outer diameter of cylindrical partition 91 is selected to be equal to or slightly smaller than the inside diameter of header pipes 130 and 140. The latter two described embodiments of the partition can be interchanged with partitions and plugs 71, 72 and 75, and 15–18, respectively, as shown in FIG. 7.

Figure 1:
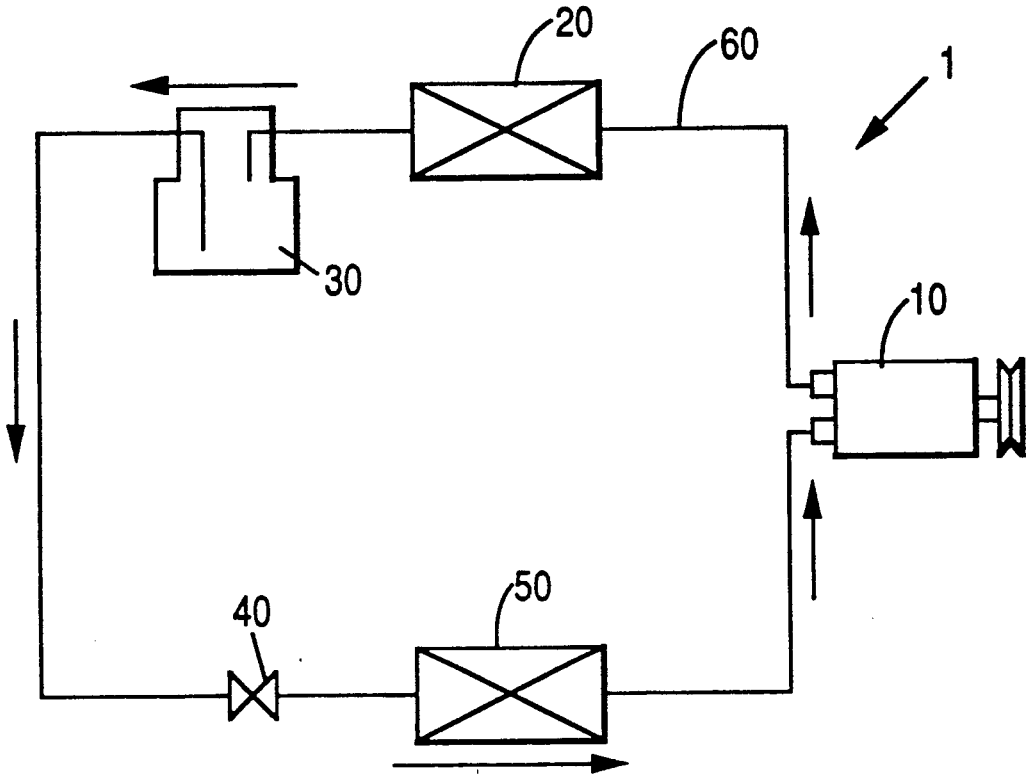
FIG. 1 PRIOR ART
FIG. 1 is a schematic block diagram of a refrigerant circuit in accordance with the prior art.
Figure 2:
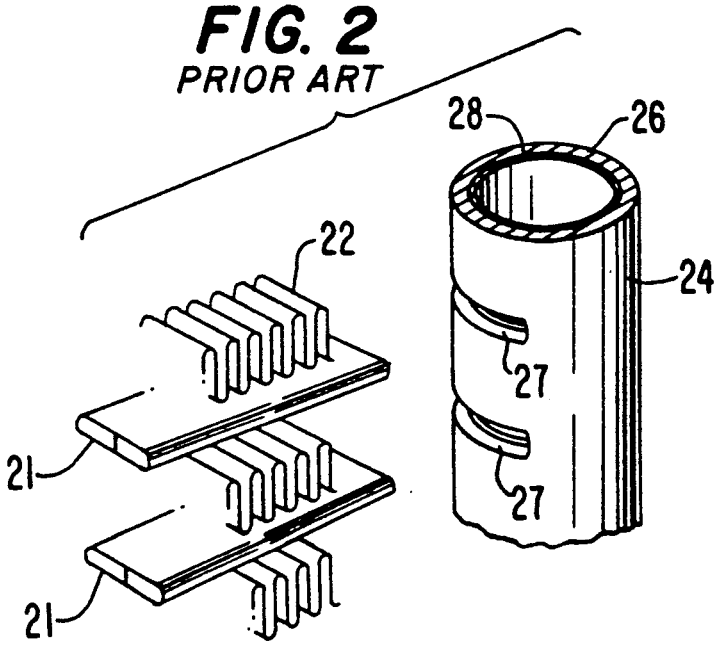
FIG. 2 PRIOR ART
FIG. 2 is a perspective view of certain elements of the condenser shown in FIG. 1*a*.
Figure 1A:
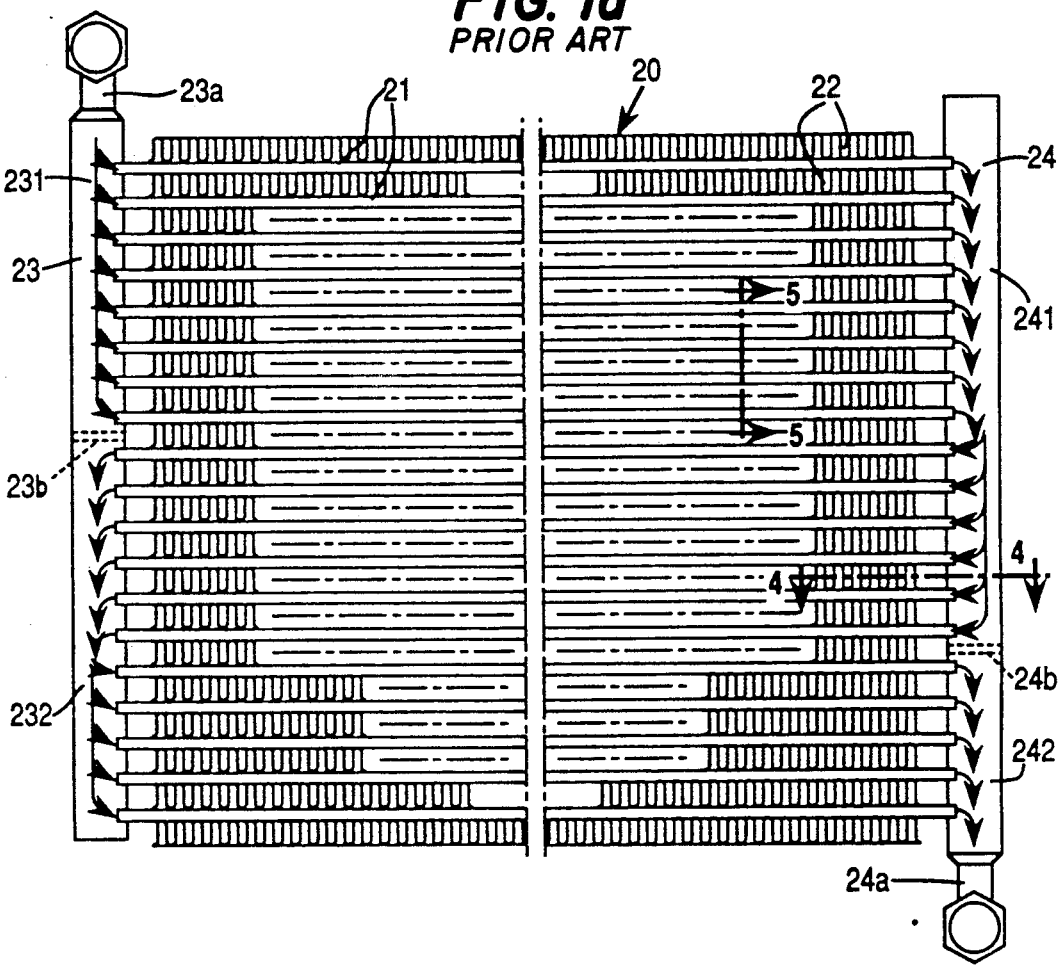
FIG. 1a PRIOR ART
FIG. 1*a* is an elevational view of the condenser shown in the refrigerant circuit of FIG. 1.
Figure 3:
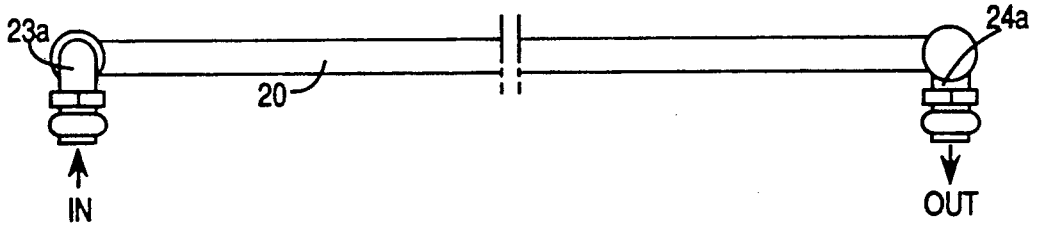
FIG. 3 PRIOR ART
FIG. 3 is a top view of the condenser shown in the prior art of FIG. 1*a*.
Figure 4:
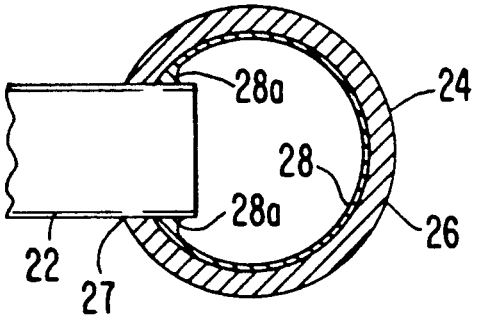
FIG. 4 PRIOR ART
FIG. 4 is a partial cross-section along line 4—4 in FIG. 1*a*.
Figure 5:
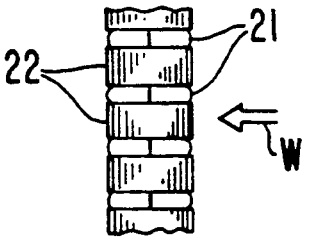
FIG. 5 PRIOR ART
FIG. 5 is a partial cross-section along line 5—5 in FIG. 1*a*.
Figure 6:
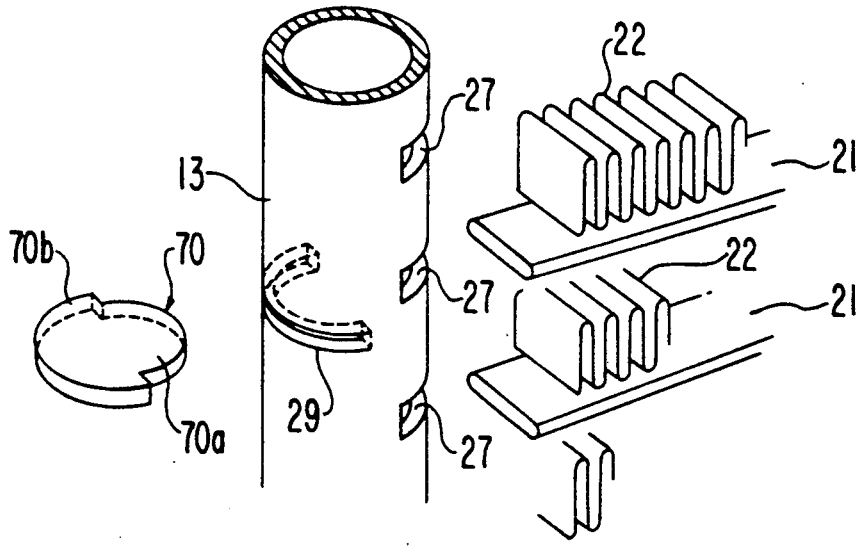
FIG. 6 PRIOR ART
FIG. 6 is a perspective view showing a partition according to the prior art.

The construction of a condenser of the present invention is as follows:

Plug 16 is first inserted into the interior of header pipe 130 through the upper opening thereof, and is then moved by a rod to the lower end of header pipe 130. Partitions 71 and 72 are also inserted in header pipe 130 and moved to their predetermined positions, respectively. Finally, plug 15 is inserted at the upper end of header pipe 130. Since the outer diameter of the plugs and the partitions is predetermined to be approximately the same as or slightly less than the inner diameter of the header pipe, the partitions may be moved smoothly to their respective positions in the header pipe. Additionally, since in all three embodiments the partitions include a horizontal portion and a peripheral portion extending essentially perpendicularly to the horizontal portion and having a central longitudinal axis which is coincident with the longitudinal axis of the header pipes, the partition will not undergo undesirable rotation about an axis perpendicular to the longitudinal axis of the header pipes during insertion. That is, during insertion the partition will remain in an upright orientation and will not flip in the header pipe as it is moved downwardly therein. Pressure is applied through header pipe 130 to each plug and partition by a press to fix their position in header pipe 130 after each has been inserted therein. Partition 75 and plugs 17 and 18 are inserted and fixed within header pipe 140 in a similar manner. After header pipes 130 and 140 are assembled, the remaining parts of the condenser including tubes 21 and pipes 230 and 240 are fixed to the header pipes by brazing. In this case, header pipes 130 and 140 would include a brazing layer as shown in FIG. 4. The condenser may also be assembled by soldering as discussed with respect to FIG. 6. In this case, the soldering layer would be coated on the header pipe and the flat tubes, as well as inlet pipe 230 and outlet pipe 240.

This invention has been described in detail in connection with the preferred embodiments. These embodiments, however, are merely for example only and the invention is not restricted thereto. It will be understood by those skilled in the art that other variations and modifications can easily be made within the scope of this invention, as defined by the appended claims.

I claim:

1. A condenser for a refrigerant fluid circuit comprising:

a plurality of tubes having opposite first and second open ends;

a plurality of fin units disposed between said plurality of tubes;

first and second header pipes having at least one open end and fixedly disposed at said opposite ends of said tubes, respectively, said open ends of said tubes disposed in fluid communication with the interior of said header pipes, said first header pipe having an inlet means for linking the condenser in fluid communication to an external element of the circuit and an outlet means for linking the condenser in fluid communication to an external element of the circuit; and partition means for dividing said first header pipe into at least a first and a second chamber which are isolated from each other, said inlet means linked in fluid communication to said first chamber and said outlet means linked in fluid communication to said second chamber, said partition means insertable into said at least one header pipe from an open end thereof, said partition means including a solid conical slice portion and a hollow conical slice portion extending from said solid conical slice portion.

2. The condenser recited in claim 1, the outer diameter of said partition means being approximately the same as the inner diameter of the header pipes.

3. The condenser recited in claim 1 wherein said tubes are soldered in slots formed within said header pipes, said soldering substance coated in the interior of said header pipes or on said tubes prior to the joining of said header pipes with said tubes.

4. The condenser recited in claim 1 wherein said tubes are brazed in slots formed within said header pipes, said brazing substance coated in the interior of said header pipes or on said tubes prior to the joining of said header pipes with said tubes.

5. The condenser recited in claim 1 further comprising plugs inserted in the open ends of said header pipes, said plugs comprising said partition means.

6. The condenser recited in claim 1 wherein said condenser inlet means and outlet means are attached to said first header pipe.

7. A condenser for a refrigerant fluid circuit comprising:

a plurality of tubes having opposite first and second open ends;

a plurality of fin units disposed between said plurality of tubes;

first and second header pipes having at least one open end and fixedly disposed at said opposite ends of said tubes, respectively, said open ends of said tubes disposed in fluid communication with the interior of said header pipes, said first header pipe having an inlet means for linking the condenser in fluid communication to an external element of the circuit and an outlet means for linking the condenser in fluid communication to an external element of the circuit; and partition means for dividing said first header pipe into at least a first and a second chamber which are isolated from each other, said inlet means linked in fluid communication to said first chamber and said outlet means linked in fluid communication to said second chamber, said partition means insertable into said at least one header pipe from an open end thereof, said partition means having an overall frusto-conical shape and including a frusto-conical hole extending partially therethrough from the base.

8. A refrigerant circuit comprising a compressor, a condenser, a receiver, an expansion element and an evaporator sequentially disposed, said condenser comprising a plurality of tubes having opposite first and second open ends, a plurality of fin units disposed between said plurality of tubes, first and second header pipes fixedly disposed at said opposite ends, respectively, said open ends of said tubes disposed in fluid communication with the interior of said header pipes, said condenser having an inlet means for linking the condenser to an external element of the circuit and an outlet means for linking the condenser to another external element of the circuit, at least one of said header pipes further including at least one partition means for dividing it into at least a first chamber and a second chamber which are isolated from each other, said inlet means linked in fluid communication to said first chamber and said outlet means linked in fluid communication to said second chamber, said partition means insertable into at least one of said header pipes from an open end thereof, said partition means comprising a solid conical slice portion and a hollow conical slice portion extending from said solid conical slice portion.

9. The circuit recited in claim 8 the outer diameter of said partition means being approximately the same as the inner diameter of the header pipes.

10. The circuit recited in claim 8 wherein said tubes are soldered in slots formed within said header pipes, said soldering substance coated in the interior of said header pipes or on said tubes prior to the joining of said header pipes with said tubes.

11. The circuit recited in claim 8 wherein said tubes are brazed in slots formed within said header pipes, said brazing substance coated in the interior of said header pipes or on said tubes prior to the joining of said header pipes with said tubes.

12. The circuit recited in claim 8 further comprising plugs inserted in the open ends of said header pipes, said plugs comprising said partition means.

13. A refrigerant circuit comprising a compressor, a condenser, a receiver, an expansion element and an evaporator sequentially disposed, said condenser comprising a plurality of tubes having opposite first and second open ends, a plurality of fin units disposed between said plurality of tubes, first and second header pipes fixedly disposed at said opposite ends, respectively, said open ends of said tubes disposed in fluid communication with the interior of said header pipes, said condenser having an inlet means for linking the condenser to an external element of the circuit and an outlet means for linking the condenser to another external element of the circuit, at least one of said header pipes further including at least one partition means for dividing it into at least a first chamber and a second chamber which are isolated from each other, said inlet means linked in fluid communication to said first chamber and said outlet means linked in fluid communication to said second chamber, said partition means insertable into at least one of said header pipes from an open end thereof, said partition means having an overall frusto-conical shape and including a frusto-conical hole extending partially therethrough from the base.

14. A condenser for a refrigerant fluid circuit comprising:

a plurality of tubes having opposite first and second open ends;

a plurality of fin units disposed between said plurality of tubes;

first and second header pipes having at least one open end and fixedly disposed at said opposite ends of said tubes, respectively, said open ends of said tubes disposed in fluid communication with the interior of said header pipes, said first header pipe having an inlet means for linking the condenser in fluid communication to an external element of the circuit and an outlet means for linking the condenser in fluid communication to an external element of the circuit; and partition means for dividing said first header pipe into at least a first and a second chamber which are isolated from each other, said partition means fixed in position within said header pipe by application of pressure to said header pipe at the location of said partition means, said inlet means linked in fluid communication to said first chamber and said outlet means linked in fluid communication to said second chamber, said partition means insertable into said first header pipe from an open end thereof, said partition means including a solid conical slice portion and a hollow conical slice portion extending perpendicularly to said solid conical slice portion.

15. A condenser for a refrigerant fluid circuit comprising:

a plurality of tubes having opposite first and second open ends;

a plurality of fin units disposed between said plurality of tubes;

first and second header pipes having at least one open end fixedly disposed at said opposite ends of said tubes, respectively, said open ends of said tubes disposed in fluid communication with the interior of said header pipes, said first header pipe having an inlet means for linking the condenser in fluid communication to an external element of the circuit and an outlet means for linking the condenser in fluid communication to an external element of the circuit; and partition means for dividing said first header pipe into at least a first and a second chamber which are isolated from each other, said partition means fixed in position within said header pipe by application of pressure to said header pipe at the location of said partition means, said inlet means linked in fluid communication to said first chamber and said outlet means linked in fluid communication to said second chamber, said partition means insertable into said first header pipe from an open end thereof, said partition means having an overall frusto-conical shape and including a frusto-conical hole extending partially therethrough from the base.

16. A refrigerant circuit comprising a compressor, a condenser, a receiver, an expansion element and an evaporator sequentially disposed, said condenser comprising a plurality of tubes having opposite first and second open ends, a plurality of fin units disposed between said plurality of tubes, first and second header pipes fixedly disposed at said opposite ends, respectively, said open ends of said tubes disposed in fluid communication with the interior of said header pipes, said condenser having an inlet means for linking the condenser to an external element of the circuit and an outlet means for linking the condenser to another external element of the circuit, at least one of said header pipes further including at least one partition means for dividing it into at least a first chamber and a second chamber which are isolated from each other, said inlet means linked in fluid communication to said first chamber and said outlet means linked in fluid communication to said second chamber, said partition means insertable into said at least one header pipe from an open end thereof, said partition means comprising a solid conical slice portion and a hollow conical slice portion extending perpendicularly to said solid conical slice portion, said partition means fixed in position within said header pipe by application of pressure to said header pipe at the location of said partition means.

17. A refrigerant circuit comprising a compressor, a condenser, a receiver, an expansion element and an evaporator sequentially disposed, said condenser comprising a plurality of tubes having opposite first and second open ends, a plurality of fin units disposed between said plurality of tubes, first and second header pipes fixedly disposed at said opposite ends, respectively, said open ends of said tubes disposed in fluid communication with the interior of said header pipes, said condenser having an inlet means for linking the condenser to an external element of the circuit and an outlet means for linking the condenser to another external element of the circuit, at least one of said header pipes further including at least one partition means for dividing it into at least a first chamber and a second chamber which are isolated from each other, said inlet means linked in fluid communication to said first chamber and said outlet means linked in fluid communication to said second chamber, said partition means insertable into said at least one header pipe from an open end thereof, said partition means having an overall frusto-conical shape and including a frusto-conical hole extending partially therethrough from the base, said partition means fixed in position within said header pipe by application of pressure to said header pipe at the location of said partition means.

* * * * *